US008454387B2

(12) United States Patent
Peng et al.

(10) Patent No.: US 8,454,387 B2
(45) Date of Patent: Jun. 4, 2013

(54) ELECTRICAL CONNECTOR ASSEMBLY WITH AN IMPROVED METALLIC SHELL

(75) Inventors: Fei-Yan Peng, Shenzhen (CN); Xian-Kui Shi, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 4 days.

(21) Appl. No.: 13/326,858

(22) Filed: Dec. 15, 2011

(65) Prior Publication Data

US 2012/0156935 A1 Jun. 21, 2012

(51) Int. Cl.
*H01R 13/648* (2006.01)

(52) U.S. Cl.
USPC ..... 439/607.35; 439/660

(58) Field of Classification Search
USPC ..... 439/607.01, 607.35–607.4, 607.55, 439/660
See application file for complete search history.

(56) References Cited

U.S. PATENT DOCUMENTS

| | | | | |
|---|---|---|---|---|
| 5,419,722 | A * | 5/1995 | Onoda | 439/752 |
| 8,038,480 | B2 * | 10/2011 | Wei | 439/660 |
| 2012/0129398 | A1 * | 5/2012 | Droesbeke | 439/607.55 |
| 2012/0156935 | A1 * | 6/2012 | Peng et al. | 439/626 |
| 2012/0225583 | A1 * | 9/2012 | Kamarauskas et al. | 439/607.01 |

FOREIGN PATENT DOCUMENTS

| | | | |
|---|---|---|---|
| CN | 2558106 | Y | 6/2003 |
| CN | 101136524 | A | 3/2008 |
| CN | 101364692 | A | 2/2009 |
| CN | 101364694 | A | 2/2009 |
| CN | 201355687 | Y | 12/2009 |

* cited by examiner

*Primary Examiner* — James Harvey
(74) *Attorney, Agent, or Firm* — Wei Te Chung; Ming Chieh Chang

(57) ABSTRACT

An electrical connector assembly (100) comprises an insulative housing (1) having a pair of protrusions (102) on both sides thereof, a plurality of contacts (2) received in the insulative housing and a metallic shell (4) enclosing the insulative housing. The metallic shell has a pair of elastic portions (401) on lateral sides thereof, and the elastic portions are bent inwards and adjacent to corresponding back surfaces of the protrusions.

17 Claims, 4 Drawing Sheets

ELECTRICAL CONNECTOR ASSEMBLY WITH AN IMPROVED METALLIC SHELL

BACKGROUND OF THE INVENTION

1. Field of the Invention

The present invention generally relates to an electrical connector assembly, and more particularly to an electrical connector assembly compatible to standard Universal Serial Bus (USB) connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. USB can connect peripherals such as mouse devices, keyboards, PDAs, gamepads and joysticks, scanners, digital cameras, printers, external storage, networking components, etc.

A conventional electrical connector assembly compatible to standard Universal Serial Bus (USB) comprises an insulative housing and a plurality of contacts assembled to the insulative housing, and the contacts include a first set of contacts and a second set of contacts, one set of the first set of contacts and the second set of contacts are molded in the insulative housing, and the other set are assembled in the insulative housing. However the precision of a plastic mold wherein the contacts molded in is required very high, and the manufacture cost will be higher.

Hence, it is desirable to have an improved structure to overcome the above-mentioned disadvantages of the prior art.

BRIEF SUMMARY OF THE INVENTION

Accordingly, the object of the present invention is to provide an electrical connector assembly with lower manufacture cost.

In order to achieve the above-mentioned object, an electrical connector assembly in accordance with the present invention comprises an insulative housing having a pair of protrusions on both sides thereof, a plurality of contacts received in the insulative housing and a metallic shell enclosing the insulative housing. The metallic shell has a pair of elastic portions on lateral sides thereof, and the elastic portions are bent inwards and adjacent to corresponding back surfaces of the protrusions.

Other objects, advantages and novel features of the invention will become more apparent from the following detailed description of the present embodiment when taken in conjunction with the accompanying drawings.

DETAILED DESCRIPTION OF THE INVENTION

Figure 1:
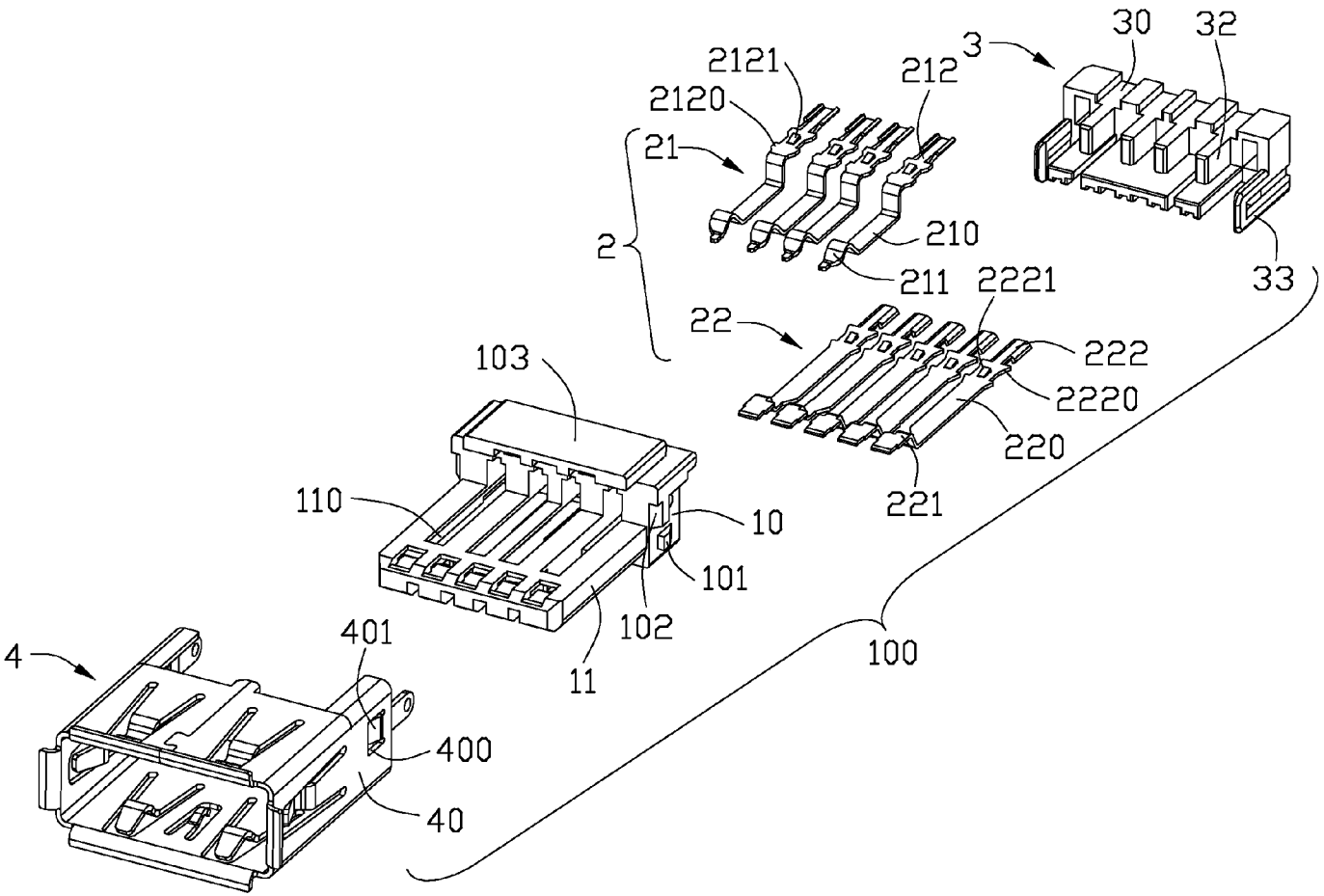
FIG. 1 is an exploded perspective view of an electrical connector assembly in accordance with the present invention.

Reference will now be made to the drawing figures to describe the present invention in detail.

Figure 2:
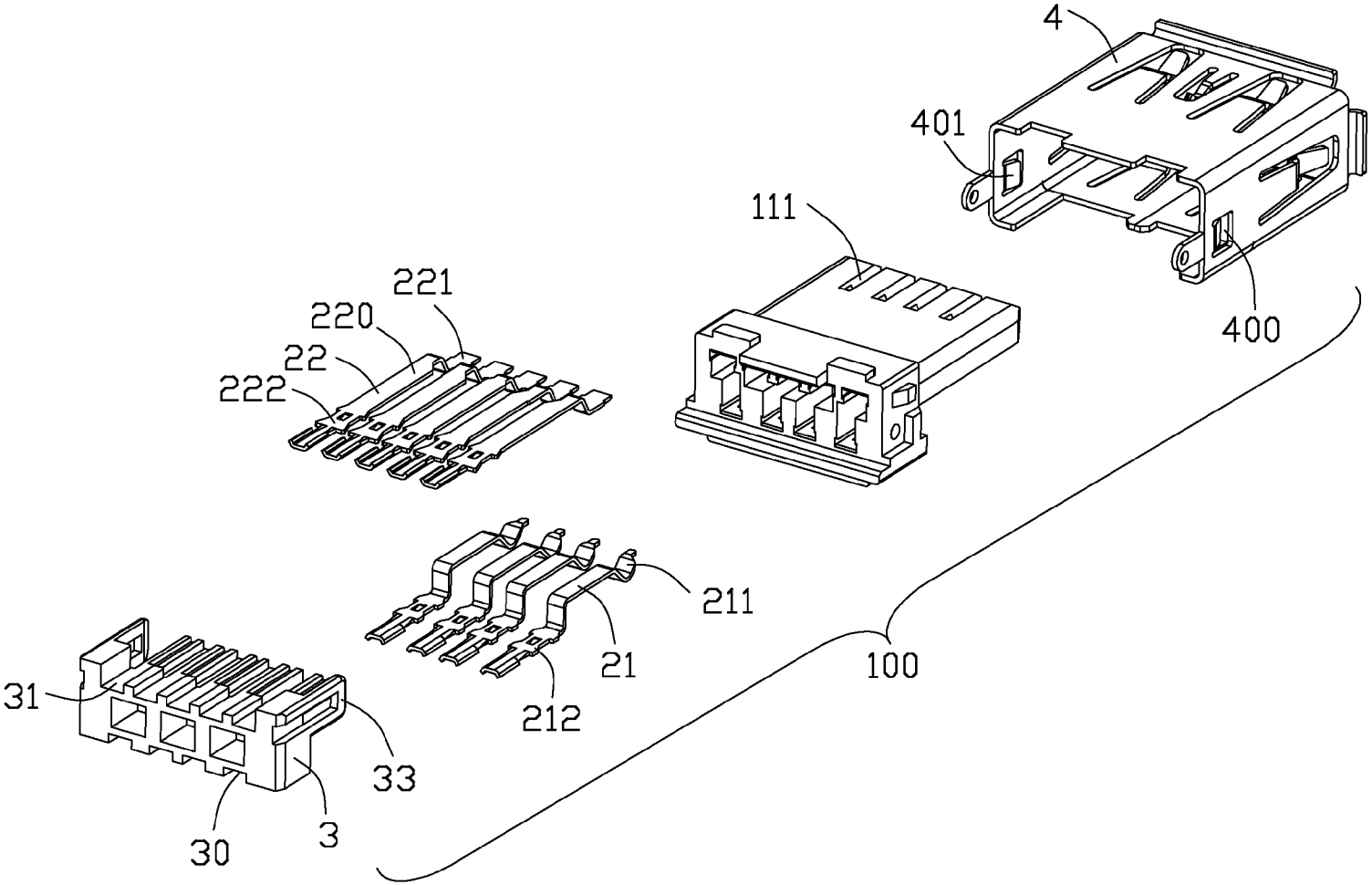
FIG. 2 is a view similar to FIG. 1, but viewed from a different angle.
Figure 3:
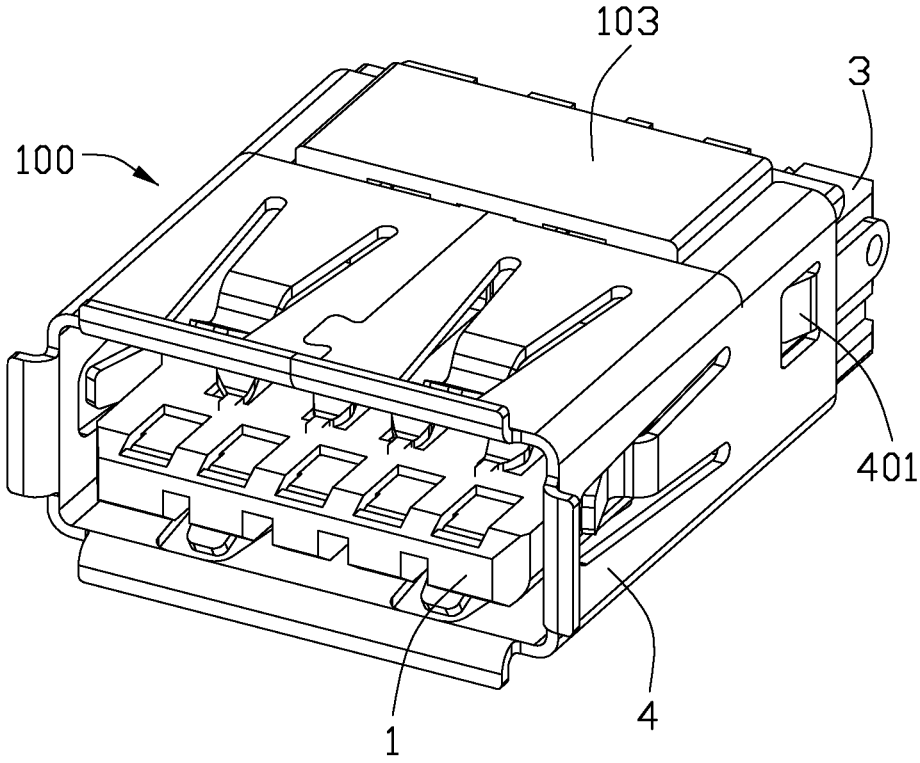
FIG. 3 is an assembled perspective view of the electrical connector assembly shown in FIG. 1.

Referring to FIGS. 1-3, an electrical connector assembly 100 made in accordance with the present invention comprises an insulative housing 1, a plurality of contacts 2 received in the insulative housing 1, a spacer 3 arranged behind the insulative housing 1 and a metallic shell 4 enclosing on the insulative housing 1.

Referring to FIGS. 1-2, the insulative housing 1 includes a main portion 10 and a tongue portion 11 extending forwards from the main portion 10, the main portion 10 has a top surface higher than an upper surface of the tongue portion 11, and the main portion 10 has a bottom plane lower than a lower plane of the tongue portion 11. The contacts 2 include a group of first contacts 21 in an upper row and a group of second contacts 22 located in a lower row. The tongue portion 11 of the insulative housing 1 has a group of receiving channels 110 on the upper surface to receive the first contacts 21 and a group of passageways 111 on the lower plane to receive the second contacts 22. The receiving channels 110 and the passageways 111 are stagger with each other along a transverse direction, and the receiving channels 110 and the passageways 111 are extending backwards to communicate with a rear surface of the main portion 10. A pair of tabs 101 are defined on lateral sides of the main portion 10, and a protrusion 102 is defined above each tab 101 on lateral sides. The main portion 10 of the insulative housing 1 defines a projecting portion 103 on the top surface thereof, and the projecting portion 103 is of rectangular shape.

The first contacts 21 include four conductive contacts, and each first contact 21 comprises a first body section 210, a first contacting section 211 extending upwards and forwards from the first body section 210 and a first tail section 212 extending upwards and rearwards from the first body section 210. A plurality of first barbs 2120 are arranged on lateral sides of each first contact 21, and the first barbs 2120 are located in front of the first tail section 212 and neighboring to the first body section 210. A second barb 2121 is defined on a top surface of each first contact 21, and the second barb 2121 is also arranged in front of the first tail section 212 and neighboring to the first body section 210.

The second contacts 22 include five conductive contacts, and each second contact 22 comprises a second body section 220, a second contacting section 221 extending upwards and forwards from the second body section 220 and a second tail section 222 extending rearwards from the second body section 220. A plurality of third barbs 2220 are arranged on lateral sides of each second contact 22, and the third barbs 2220 are located in front of the second tail section 222 and neighboring to the second body section 220. A fourth barb 2221 is defined on a top surface of each second contact 22, and the fourth barb 2221 is also arranged in front of the third tail section 222 and neighboring to the second body section 220.

The spacer 3 comprises a plurality of first slots 30 on an upper plane thereof to receive the first tail sections 212 of the first contacts 21 and a plurality of second slot 31 on a lower plane thereof to receive the second tail sections 222 of the second contacts 22. The first slots 30 are recessed downwards from the upper plane of a rear segment of the spacer 3, and a plurality of ribs 32 are defined in front of the first slots 30 and aligned with the corresponding first slots 30, to support a conjunction section (not labeled) between each first body section 210 and the relative first tail section 212. The spacer 3 has a pair of latch arms 33 on opposite sides thereof to lock with the corresponding tabs 101.

The electrical connector assembly 100 further comprises a metallic shell 4 enclosing the insulative housing 1, and the metallic shell 4 defines a pair of through holes 400 on lateral walls 40, the through holes 400 are neighboring to a rear end of the metallic shell 4. An elastic portion 401 is defined in each through hole 400 and bent inwards from a back wall of the through hole 400.

Figure 4:
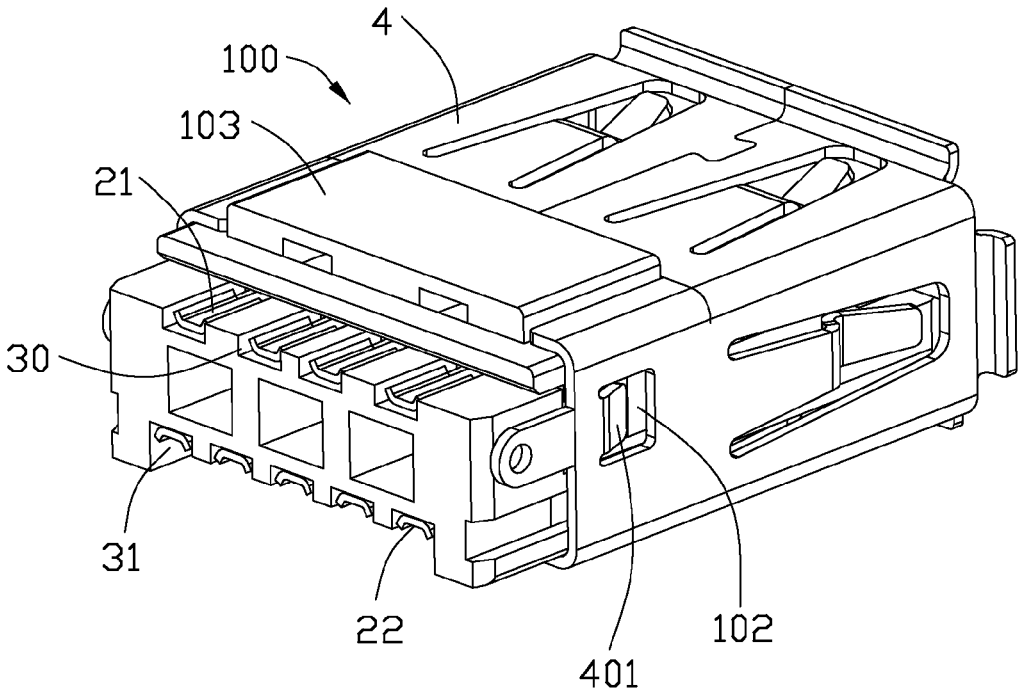
FIG. 4 is a view similar to FIG. 3, but viewed from a different angle.

Referring to FIGS. 1-2, and conjunction with FIGS. 3-4, in assembly, the second contacts 22 are assembled into the passageways 111 of the insulative housing 1 firstly, and the second contacts 22 are retained in the insulative housing via the third barbs 2220 and the fourth barbs 2221. The first contacts 21 are assembled into the receiving channels 110 of the insulative housing 1, and the first contacts 21 are retained in the insulative housing 1 via the first barbs 2120 and the second barbs 2121, therefore the first body sections 210 and the second body sections 220 are located on opposite surfaces of the insulative housing 1, and the first contacting sections 211 and the second contacting sections 221 are located on the upper surface of the tongue portion 11, the second contacting sections 221 are in front of the first contacting sections 211.

Then the spacer 3 is assembled to a back end of the insulative housing 1 along a rear-to-front direction, and sandwiched between the first tail sections 212 and the second tail sections 222. The first tail sections 212 of the first contacts 21 are held in the corresponding first slots 30, and the ribs 32 are adjacent to the conjunction sections of the first tail sections 212 and the first body sections 210. The second tail sections 222 of the second contacts 22 are held in the second slots 31 of the spacer 3, the latch arms 33 of the spacer 3 are locked with the corresponding tabs 101 to fasten the spacer 3 to the insulative housing 1. Then the metallic shell 4 is assembled to the insulative housing 1 and a front end of the projecting portion 103 is adjacent to a rear end of the metallic shell 4 to prevent being detached from each other, the elastic portions 401 of the metallic shell 4 are adjacent to corresponding back surfaces of the protrusions 102, so the metallic shell 4 is assembled to the insulative housing 1 stably. Thus, the electrical connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative housing having a pair of protrusions on both sides thereof;

a plurality of contacts received in the insulative housing; and a metallic shell enclosing the insulative housing and having a pair of elastic portions on lateral sides thereof;

wherein the elastic portions are bent inwards and adjacent to corresponding back surfaces of the protrusions;

the electrical connector assembly further comprises a spacer assembled to a back end of the insulative housing, and the spacer has a pair of latch arms extending forwards on lateral walls, the latch arms are locked with the corresponding tabs to fasten the spacer to the insulative housing.

2. The electrical connector assembly as claimed in claim 1, wherein the insulative housing comprises a main portion and a tongue portion extending forwards from the main portion, and a projecting portion is defined on the main portion, a front end of the projecting portion is adjacent to a rear end of the metallic shell.

3. The electrical connector assembly as claimed in claim 2, wherein the insulative housing has a pair of tabs on both sides thereof, and each tab is located below the corresponding protrusion.

4. An electrical connector comprising:

an insulative housing defining a base with a mating tongue extending forwardly therefrom in a front-to-back direction and spanning in a transverse direction perpendicular to said front-to-back direction;

four first passageways arranged in one row in the transverse direction and extending in the front-to-back direction;

five second passageways arranged in another row in the transverse direction and extending in the front-to-back direction;

four first contacts disposed in the corresponding first passageways with moveable contacting sections;

five second contacts disposed in the corresponding second passageways with immoveable contacts sections in front of the moveable contacts in the front-to-back direction; and a spacer attached to the housing and defining two rows of slots opposite to each other in a vertical direction perpendicular to the transverse direction and the front-to-back direction; wherein tails of the first contacts and those of the second contacts are respectively received in the corresponding slots, to secure to corresponding wires.

5. The electrical connector assembly as claimed in claim 1, wherein the contacts are divided into a group of first contacts in an upper row and a group of second contacts located in a lower row, and the spacer is sandwiched between the first contacts and the second contacts.

6. The electrical connector assembly as claimed in claim 5, wherein each first contact defines a plurality of first barbs on lateral sides thereof and a second barb on a top surface thereof to make the first contacts being retained in the insulative housing.

7. The electrical connector assembly as claimed in claim 6, wherein each second contact defines a plurality of third barbs on lateral sides thereof and a fourth barb on a top surface thereof to make the second contacts being retained in the insulative housing.

8. The electrical connector assembly as claimed in claim 7, wherein each first contact comprises a first body section and a first tail section extending upwards and rearwards from the first body section, and the spacer has a plurality of first slots on an upper plane thereof to receive the first tail sections of the first contacts.

9. The electrical connector assembly as claimed in claim 8, wherein the each second contact comprises a second body section and a second tail section extending upwards and rearwards from the second body section, and the spacer has a plurality of second slots on a lower plane thereof to receive the second tail sections of the second contacts.

10. The electrical connector assembly as claimed in claim 9, wherein a plurality of ribs are defined in front of the first slots and aligned with the corresponding first slots, to support a conjunction section between each first body section and the relative first tail section.

11. An electrical connector comprising:

an insulative housing defining a base with a mating tongue extending forwardly therefrom in a front-to-back direction and spanning in a transverse direction perpendicular to said front-to-back direction;

four first passageways arranged in one row in the transverse direction and extending in the front-to-back direction;

five second passageways arranged in another row in the transverse direction and extending in the front-to-back direction;

the two outer first passageways being joined with the two corresponding outer second passageways, respectively, in a vertical direction perpendicular to both said front-to-back direction and said transverse direction;

the three inner second passageways being joined with one another in the transverse direction and further joined with the two corresponding inner second passageways in the vertical direction;

four first contacts disposed in the corresponding first passageways with moveable contacting sections; and fiver second contacts disposed in the corresponding second passageways with immoveable contacts sections in front of the moveable contacts in the front-to-back direction.

12. The electrical connector as claimed in claim 11, further including a spacer attached to the housing.

13. The electrical connector as claimed in claim 12, wherein said spacer includes four forwardly extending protrusions received in the corresponding four first passageways, respectively.

14. The electrical connector as claimed in claim 13, wherein said spacer includes three forwardly extending protrusions received in the two outer second passageways and the joined three inner second passageways, respectively.

15. The electrical connector as claimed in claim 12, wherein the spacer defines two rows of slots opposite to each other to receive solder tails of the corresponding first contacts and second those of the second contacts, respectively.

16. The electrical connector as claimed in claim 4, wherein the spacer includes a pair of side arms to secure to the housing.

17. The electrical connector as claimed in claim 4, further including a metallic shell enclosing the housing and a portion of the spacer.

* * * * *